US008992707B2

(12) United States Patent
Comet et al.

(10) Patent No.: US 8,992,707 B2
(45) Date of Patent: Mar. 31, 2015

(54) EXPLOSIVE COMPOSITION HAVING A FIRST ORGANIC MATERIAL INFILTRATED INTO A SECOND MICROPOROUS MATERIAL

(75) Inventors: Marc Comet, Huningue (FR); Denis Spitzer, Oberschaeffolshein (FR); Vincent Pichot, Mulhouse (FR)

(73) Assignee: Institute Franco-Allemand de Recherches de Saint-Louis, Saint Louis (FR)

( * ) Notice: Subject to any disclaimer, the term of this patent is extended or adjusted under 35 U.S.C. 154(b) by 1143 days.

(21) Appl. No.: 12/285,463

(22) Filed: Oct. 6, 2008

(65) Prior Publication Data

US 2012/0118448 A1 May 17, 2012

(30) Foreign Application Priority Data

Oct. 5, 2007 (FR) ..... 07 07016

(51) Int. Cl.

| | |
|---|---|
| ***C06B 31/00*** | (2006.01) |
| ***C06B 31/28*** | (2006.01) |
| ***C06B 29/00*** | (2006.01) |
| ***D03D 23/00*** | (2006.01) |
| ***D03D 43/00*** | (2006.01) |
| ***C06B 45/00*** | (2006.01) |
| ***C06B 21/00*** | (2006.01) |
| ***C06B 33/00*** | (2006.01) |

(52) U.S. Cl.

CPC ..... *C06B 45/00* (2013.01); *C06B 21/0066* (2013.01); *C06B 33/00* (2013.01)

USPC ..... 149/46; 149/45; 149/75; 149/109.4; 149/109.6

(58) Field of Classification Search

USPC ..... 149/46, 45, 75, 109.4, 109.6

See application file for complete search history.

(56) References Cited

U.S. PATENT DOCUMENTS

| | | | | |
|---|---|---|---|---|
| 5,540,793 | A * | 7/1996 | Bals et al. | 149/2 |
| 2002/0003016 | A1 * | 1/2002 | Ampleman et al. | 149/18 |
| 2002/0193040 | A1 * | 12/2002 | Zhou | 445/51 |

OTHER PUBLICATIONS

S.H. Fischer & M.C. Gruebelich, Theoretical Energy Release of Thermites, Intermetallics, and Combustible Metals, Proceedings of the 24th International Pyrotechnics Seminar, Jul. 27-31, 1998.

J. Quinchon, Les Poudres, Propergols et Explosifs (Powders, Propergols, and Explosives), vol. 4, 113-121, Ed. Technique et Documentation Lavoisier (1991).

* cited by examiner

*Primary Examiner* — James McDonough

(74) *Attorney, Agent, or Firm* — Oliff PLC

(57) ABSTRACT

An energetic composition with controlled detonation having at least a first organic material and a second material, where the second material is a porous material (micro-, meso-, or macroporous), having a pore ratio of at least 10% and preferably greater than 50%, and the first material is, at least partially, infiltrated into the pores of the second material. A mixture containing such a composition, and a method for manufacturing such a composition and such a mixture. Additionally, a method for fragmenting or expanding a microporous material at nanoscale.

13 Claims, No Drawings

EXPLOSIVE COMPOSITION HAVING A FIRST ORGANIC MATERIAL INFILTRATED INTO A SECOND MICROPOROUS MATERIAL

FIELD OF THE INVENTION

The present invention relates to energetic compositions whose decomposition (combustion, deflagration, detonation) can be controlled through the structure of their components.

DESCRIPTION OF RELATED ART

Energetic compositions of the "thermite" type are materials which undergo chemical decomposition when they are primed by appropriate initiation, releasing a very large quantity of thermal energy. This decomposition is a reaction in which oxygen atoms are exchanged between two solids, namely a reducing metal (oxygen acceptor) and a metal oxide (oxygen donor).

The products formed during this oxidation-reduction process are generally liquid or solid. For this reason, in particular, thermites are not considered to be proper explosives, but materials with a high energetic potential. The thermodynamic properties of several hundred binary compositions of the thermite type are reported, for example, in S. H. Fischer & M. C. Grueblich, *Theoretical Energy Release of Thermites, Intermetallics, and Combustible Metals*, Proceedings of the 24th International Pyrotechnics Seminar, Jul. 27-31, 1998.

Since thermal decomposition of these materials involves a mass transfer, their combustion kinetics are limited by the size and relative arrangement of the particles of each component. Reduction to a nanometric scale of the size of the oxide and metal particles increases the reactivity of these materials and increases their rate of combustion.

Composite energetic materials such as composite explosives and composite propergols having solid polymer matrices are also known.

A composite explosive is a pyrotechnic composition which can detonate, containing a solid polymer matrix and at least one organic nitrated molecule, such as, for example, hexogen (RDX), octogen (HMX), or oxynitrotriazole (ONTA) in powder form. These composite explosives and the methods for obtaining them are described, for example, in J. Quinchon, *Les Poudres, Propergols et Explosifs* (Powders, Propergols, and Explosives), Vol. 1, 190-192, Ed. Technique et Documentation Lavoisier (1982).

A composite propergol is a pyrotechnic composition whose combustion produces gases which have a propulsive effect when they are accelerated through a nozzle. A composite propergol is made of a solid polymer matrix (which is often reducing) at least one oxidizing charge in powder form, possibly a reducing charge in powder form, and various additives. Examples of oxidizing charges are ammonium perchlorate, potassium perchlorate, sodium perchlorate, and ammonium and potassium nitrate. The reducing charges are, for instance metals such as aluminum and zirconium. These composite propergols are described, for example, in J. Quinchon, *Les Poudres, Propergols et Explosifs* (Powders, Propergols, and Explosives), Vol. 4, 113-121, Ed. Technique et Documentation Lavoisier (1991).

The polymer matrix is made from a liquid prepolymer that allows a high solid powder charge content, and, by careful mixing, a good distribution of the various solid components in the matrix.

Various liquid prepolymers can be used, particularly those of the polydiene type, that have carbon-carbon double bonds.

Such organic structures are not stable for a long time as homolytic chain reactions lead to degradation of the polymer matrix as it ages. This phenomenon is accelerated by the presence of free or occluded oxygen in the matrix and the presence of metal ions and induces a substantial hardening of the polymer matrix (cross-linking). These phenomena affect the properties and performance of the material, and create failures when the energetic material is used.

SUMMARY OF THE INVENTION

The goal of the invention is to remedy these drawbacks by proposing composite materials whose performances are stable over time. In addition, these materials have more energetic power than composite explosive compositions and possess a better reactivity than classical thermites.

The solution is an energetic composition with controlled decomposition having at least a first organic material and a second material, where the second material is a porous material (micro-, meso-, or macroporous) having a pore ratio of at least 10% and preferably greater than 50%, and the first material is, at least partially, infiltrated into the pores of said second material.

When this energetic composition is combusted with a reducing or oxidizing material, as the case may be, the reducing or oxidizing material being, for example, in the form of an intimate mixture with the energetic composition, the organic material or mineral infiltrated into the pores generates gases which fragment or cause expansion of the second porous material, leading to the formation of nanoparticles that react violently with said reducer or oxidizer, producing an extremely high combustion power.

According to a particular embodiment that maximizes the combustion power, the first material comprises an explosive material such as, for example, hexogen (RDX), octogen (HMX), hexanitrohexaazaisowurtzitane (CL-20), pentrite (PETN), oxynitrotriazole (ONTA) or of an inorganic salt classically used in energetic compositions such as ammonium perchlorate, potassium perchlorate, sodium perchlorate, ammonium or potassium nitrate, sodium or potassium nitride, or barium peroxide. This first material can also be a non-explosive substance that can be easily gasified (for example, polymers, porogenic agents, oxalates, etc).

According to another embodiment, the second material is, for example, an oxide, a metal, a metalloid, or a mineral or organic material, such as carbon nanotubes.

Embodiments also relate to an energetic mixture having an energetic composition and at least one reducing material such as, for example, aluminum, magnesium, silicon or zirconium.

Embodiments are also directed to a method for manufacturing an energetic composition, comprising:

dissolving the first material in a solvent;

introducing the second microporous material into the solution obtained after the dissolving step;

solidifying the first material in the second material by evaporation of the solvent or desolubilization by an antisolvent miscible with the solvent; and optionally, mixing the material obtained in the solidifying step with a reducing material, wherein the first material is, at least partially, infiltrated into the pores of the second material during the introducing step.

Embodiments also relate to a method for fragmenting into nanoparticles a microporous second material having a pore ratio of at least 10% and preferably greater than 50%, comprising infiltrating a first material into the pores of the second material, and heating or combustion of the microporous material thus infiltrated. The gases generated by the heating or combustion of the first material being able to fragment said second material into nanoparticles, and the first material being comprised of an explosive material, such as, for example, hexogen (RDX), octogen (HMX), hexanitrohexaazaisowurtzitane (CL-20), pentrite (PETN), or oxynitrotriazole (ONTA), ammonium perchlorate, potassium perchlorate, sodium perchlorate, ammonium or potassium nitrate, sodium or potassium nitride, or barium peroxide, and the second material being, for example, an oxide, a metal, a metalloid, or a mineral or organic material, such as carbon nanotubes.

DETAILED DESCRIPTION OF PREFERRED EMBODIMENTS

Other advantages and features of the invention will emerge from the description of a particular embodiment of the invention.

An explosive composition according to this particular embodiment of the invention comprises a mixture having a first organic material and a second material, the second material being microporous and the first organic material being, at least in part, infiltrated into the pores of said second material. The first and second material forming an oxidizing composition, and being mixed with a reducing material, the oxidizing composition and the reducing material being in the form of intimately mixed particles.

The first material is hexogen while the second material is chromium (III) oxide having a specific area of 46 $m^2/g$. The reducing material is aluminum nanoparticles.

The porous chromium (III) oxide having been obtained in known fashion by combustion of ammonium dichromate, the method for manufacturing this mixture has the following steps:

dissolving the hexogen in a acetone solution;

introducing the porous chromium (III) oxide into the solution obtained after the dissolving step, wherein the acetone and the dissolved hexogen become infiltrated into the pores of the porous chromium (III) oxide;

drying of the porous chromium oxide, wherein the acetone evaporates and the hexogen solidifies in the pores of the porous chromium oxide.

The porous chromium oxide infiltrated by the hexogen is then mixed with aluminum nanoparticles, and the powder that is obtained is pressed and, in known fashion, shaped into tablets.

A composition according to the invention can be used in numerous fields, for example:

Gas Generating Thermites: the oxide matrix undergoes expansion and then reacts with the aluminum nanoparticles. Such gas generating nanothermites can be prepared by using porous chromium oxide (III) doped with hexogen associated with aluminum nanoparticles;

Controlling the decomposition type (deflagration, detonation) as well as the propagation rate of these phenomena, such as controlling the detonation rates of explosives;

Synthesis by detonation of refractory nanoparticles of various types; and "in situ" activation of substances with catalytic properties (petroleum chemistry, heterogenous catalysis, etc.).

Hence, embodiments of the invention employ the infiltration of a gasifiable product (e.g., energetic material) in a matrix (for example, metal, metal alloy, metal oxide, metalloid, organic or mineral material) in order to induce its fragmentation into small particles and/or its expansion, and to use "in situ" the properties of the fragmented particles or expanded materials thus formed.

The fragmentation mechanism was established at macroscopic scale by time lapse photography and was confirmed at nanometric scale by atomic force microscopy.

While the invention has been described with reference to the embodiments, it is not restricted to the particular form shown in the aforementioned embodiments. Various modifications can be made thereto without departing from the scope of the invention.

What is claimed is:

1. An energetic material comprising a first material comprising an explosive material and a second material, the second material being a porous material (micro-, meso-, or macroporous) having a pore ratio of at least 10% and the first material being only partially infiltrated into the pores of the second material, wherein the pores of the second material are interconnected pores in communication with one another, wherein the explosive material is one or more of hexogen (RDX), octogen (HMX), hexanitrohexaazaisowurtzitane (CL-20), pentrite (PETN), oxynitrotriazole (ONTA) or an energetic composition containing an inorganic salt selected from the group consisting of ammonium perchlorate, potassium perchlorate, sodium perchlorate, ammonium nitrate, potassium nitrate, sodium nitride, potassium nitride, barium peroxide and combinations thereof.

2. An energetic material according to claim 1, wherein the second material is an oxide, a metal, a metalloid, a mineral, or an organic material.

3. A mixture comprising an energetic material according to claim 1 mixed with a reducing material, wherein the reducing material is aluminum, magnesium, silicon or zirconium.

4. A method for manufacturing an energetic material according to claim 1 comprising:

dissolving the first material in a solvent to form a solution;

introducing the second material into the solution; and solidifying the first material in the second material by evaporation of the solvent or desolubilization by an anti-solvent miscible with the solvent, wherein the first material is only partially infiltrated into the pores of the second material during the introducing step.

5. A method for manufacturing a mixture according to claim 3, comprising:

dissolving the first material in a solvent to form a solution;

introducing the second material into the solution;

solidifying the first material in the second material by evaporation of the solvent or desolubilization by an anti-solvent miscible with the solvent; and mixing the material obtained in the solidifying step with a reducing material, wherein the first material is only partially infiltrated into the pores of the second material during the introducing step.

6. A method for fragmenting into nanoparticles or expanding at nanoscale a microporous second material having pores with a pore ratio of at least 10%, wherein the pores of the second material are interconnected pores in communication with one another, comprising only partially infiltrating a first material comprising an explosive material that is one or more of hexogen (RDX), octogen (HMX), hexanitrohexaazaisowurtzitane (CL-20), pentrite (PETN), oxynitrotriazole (ONTA) or an energetic composition containing an inorganic salt selected from the group consisting of ammonium perchlorate, potassium perchlorate, sodium perchlorate, ammonium nitrate, potassium nitrate, sodium nitride, potassium nitride, barium peroxide and combinations thereof into the pores of the second material and heating or combusting the microporous material thus infiltrated, wherein gases generated by the heating or the combustion of the first material being able to fragment said second material into nanoparticles or to expand it at nanoscale.

7. A method according to claim 6, wherein the second material is an oxide, a metal, a metalloid, a mineral, or an organic material.

8. An energetic material according to claim 1, wherein the second material is a chemically inert material during an explosion of the energetic composition.

9. An energetic material comprising an explosive material and a porous material (micro-, meso-, or macroporous) having a pore ratio of at least 10% and the explosive material being infiltrated into the pores of the porous material, wherein the pores of the porous material are interconnected pores in communication with one another, wherein the explosive material is one or more of hexogen (RDX), octogen (HMX), hexanitrohexaazaisowurtzitane (CL-20), pentrite (PETN), oxynitrotriazole (ONTA) or an energetic composition containing an inorganic salt that is not an azide, and wherein the porous material is an oxide, a metal, a metalloid, a mineral, or carbon nanotubes.

10. An energetic material according to claim 1, wherein the second material is an oxide, a metal, a metalloid, a mineral, or carbon nanotubes.

11. An energetic material according to claim 1, wherein when the energetic composition is combusted with a reducing or oxidizing material, the second material forms nanoparticles.

12. An energetic material according to claim 9, wherein when the energetic composition is combusted with a reducing or oxidizing material, the porous material forms nanoparticles.

13. An energetic material according to claim 9, wherein the inorganic salt of the energetic composition is selected from a group consisting of ammonium perchlorate, potassium perchlorate, sodium perchlorate, ammonium nitrate, potassium nitrate, sodium nitride, potassium nitride, barium peroxide and combinations thereof.

* * * * *